United States Patent [19]

Dancsik

[11] Patent Number: 4,512,207

[45] Date of Patent: Apr. 23, 1985

[54] RECIPROCATING MECHANISM

[76] Inventor: Josef J. Dancsik, 37970 Pointe Rosa, Mt. Clemens, Mich. 48045

[21] Appl. No.: 414,077

[22] Filed: Sep. 2, 1982

Related U.S. Application Data

[63] Continuation of Ser. No. 305,098, Sep. 24, 1981, abandoned.

[51] Int. Cl.[3] ..... B24B 23/00; F16H 21/22

[52] U.S. Cl. ..... 74/44; 51/170 TL

[58] Field of Search ..... 74/44; 51/170 TL; 403/165, 354

[56] References Cited

U.S. PATENT DOCUMENTS

| | | | |
|---|---|---|---|
| 2,690,081 | 9/1954 | Bjorklund | 74/44 |
| 3,007,230 | 11/1961 | Riedl | 74/44 |
| 3,626,768 | 12/1971 | Dancsik | 74/44 |
| 4,233,850 | 1/1980 | Edwardson | 74/44 |
| 4,294,317 | 10/1981 | Amoroso | 173/57 |

FOREIGN PATENT DOCUMENTS

| | | | |
|---|---|---|---|
| 109031 | 11/1943 | Sweden | 403/354 |
| 673602 | 8/1950 | United Kingdom . | |
| 709853 | 3/1953 | United Kingdom . | |
| 1188550 | 4/1970 | United Kingdom | 403/165 |
| 1339546 | 8/1970 | United Kingdom . | |

*Primary Examiner*—Lawrence J. Staab

*Attorney, Agent, or Firm*—Basile, Weintraub & Hanlon

[57] ABSTRACT

A hand held reciprocating mechanism for driving an abrasive tool for finishing dies and the like is disclosed. The reciprocating mechanism of the present invention includes a housing which supports a tool holding assembly, and a drive mechanism including a crank pin which reciprocates a connecting rod which is operatively coupled to the tool holding assembly. The tool holding assembly is supported for reciprocation by a support bushing which is supported by the housing. An internal retaining ring is employed to attach a tool support housing to the tool support bushing and allow rotation of the tool support housing relative to the tool support bushing. The retaining ring allows the use of an enlarged outer end for the tool support housing with a slot formed therein to slidingly support a pair of opposed flats formed on the tool holding assembly. This permits the tool holding assembly to support heavy transverse loads without excessive wear between the tool holding assembly and the tool support housing.

5 Claims, 4 Drawing Figures

RECIPROCATING MECHANISM

This application is a continuation of application Ser. No. 305,098, filed Sept. 24, 1981, now abandoned.

BACKGROUND OF THE INVENTION

1. Field of the Invention

The present invention generally relates to the field of reciprocating mechanisms and, in particular, the present invention is concerned with hand held reciprocating mechanisms for driving an abrasive tool.

2. Description of the Prior Art

Hand held reciprocating mechanisms such as profilers for driving abrasive tools are known. The prior art devices are deficient in that they will not provide long life and are susceptible to heavy wear and early failure caused by transverse loads applied to the reciprocating tool. Examples of reciprocating mechanisms in the prior art are disclosed in U.S. Pat. Nos. 2,690,081 and 3,626,768. These patents are relevant to the Applicant's invention in that they represent the closest prior art for reciprocating mechanisms for finishing irregular surfaces such as dies and the like.

3. Prior Art Statement

The aforementioned prior art, in the opinion of the Applicant and the Applicant's Attorney, represents the closest prior art of which the Applicant and his Attorney are aware.

SUMMARY OF THE INVENTION

The present invention, which will be described in greater detail hereinafter comprises a hand held reciprocating mechanism for driving an abrasive tool for finishing dies and other irregular surfaces. The mechanism comprises a housing, a tool holding assembly supported for reciprocation by the housing, and a drive mechanism comprising a drive shaft rotating on an axis perpendicular to the direction of reciprocation. The drive shaft is supported in the housing by a pair of axially spaced bearings, and a crank pin is attached to the drive shaft having a selectively adjustable crank arm to adjust the amount of reciprocating motion. A connecting rod is operatively coupled between the crank pin and the tool holding assembly. A tool support bushing having a central bore is supported at an externally threaded inner end by the housing. The tool support bushing slidingly supports for reciprocation the tool holding assembly. A tool support housing surrounds and is rotatingly supported by an outer portion of the tool support bushing. The tool support housing includes an inner end and an enlarged outer end. A retaining ring is provided for axially securing the tool support housing to the tool support bushing which permits rotation of the tool support housing relative to the tool support bushing while preventing axial movement of the tool support housing. The retaining ring allows assembly of the tool support housing to the tool support bushing by the insertion of the tool support bushing into the tool support housing inner end leaving the enlarged outer end unobstructed for the formation of a slot. A pair of opposed flats are formed on the tool holding assembly to snugly abut the slot with the slot and opposed flats extending substantially transversely across the enlarged outer end. This provides a large bearing area between the tool holding assembly and the tool support housing to housing to accommodate heavy transverse loads without excessive wear. A shield covering the end of the tool holder assembly prevents the entry of chips and abrasives into the reciprocating mechanism which adds to the durability of the device.

It is therefore a primary object of the present invention to provide a new and improved reciprocating mechanism.

It is a further object of the present invention to provide a reciprocating mechanism for profiling and finishing irregular surfaces such as dies.

It is yet another object of the present invention to provide a reciprocating mechanism for profiling irregular surfaces that has enlarged bearing areas to absorb transverse loads without excessive wear.

It is another object of the present invention to provide a reciprocating mechanism for finishing irregular surfaces that includes a shield for preventing the entry of abrasives and chips into the area between wear surfaces.

Further objects, advantages, and application of the present invention will become apparent to those skilled in the art of reciprocating mechanisms when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numbers refer to like parts throughout the various several views, and wherein.

DESCRIPTION OF THE PREFERRED EMBODIMENT

Figures 1, 2, 3:
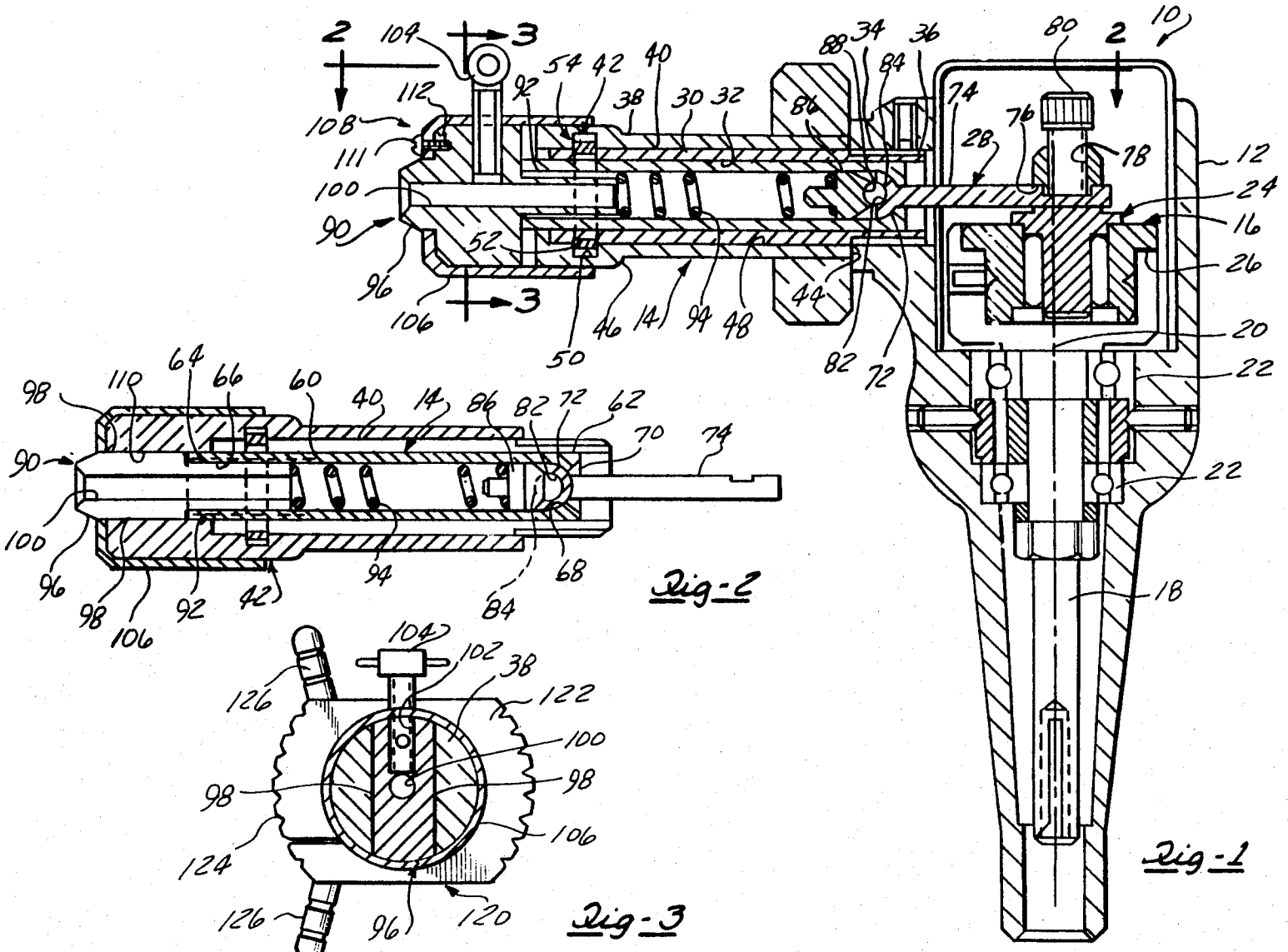
FIG. 1 illustrates a cross sectional view of the reciprocating mechanism of the present invention.
FIG. 2 illustrates a cross sectional view of the tool holding assembly of the present invention taken along the lines 2—2 in FIG. 1.
FIG. 3 is a cross sectional view through the tool holding assembly taken along the lines 3—3 of FIG. 1.

Referring now to FIG. 1 of the drawing, there is illustrated at 10 one example of the present invention in the form of a hand held reciprocating mechanism or profiler. The hand held reciprocating mechanism 10 comprises a housing 12, a tool holding assembly 14, and a drive mechanism 16 which includes a drive shaft 18 rotating on an axis 20. The tool holding assembly 14 is supported for reciprocation by the housing 12 and reciprocates in a direction perpendicular to the axis 20.

The drive shaft 18 is supported in the housing 12 by a pair of axially spaced bearings 22, and a crank pin 24 is provided at an inner end of the crank shaft. The crank pin 24 is supported by an eccentric plug 26 which is rotatable and provides a selectively adjustable reciprocating motion. A connecting rod 28 operatively couples the crank pin 24 to the tool holding assembly in a manner which will be described in greater detail subsequently.

A tool support bushing 30 is provided which has a central bore 32 and is supported by an externally threaded inner end 34 which engages a complementary threaded bore 36 in the housing 12.

Figure 4:
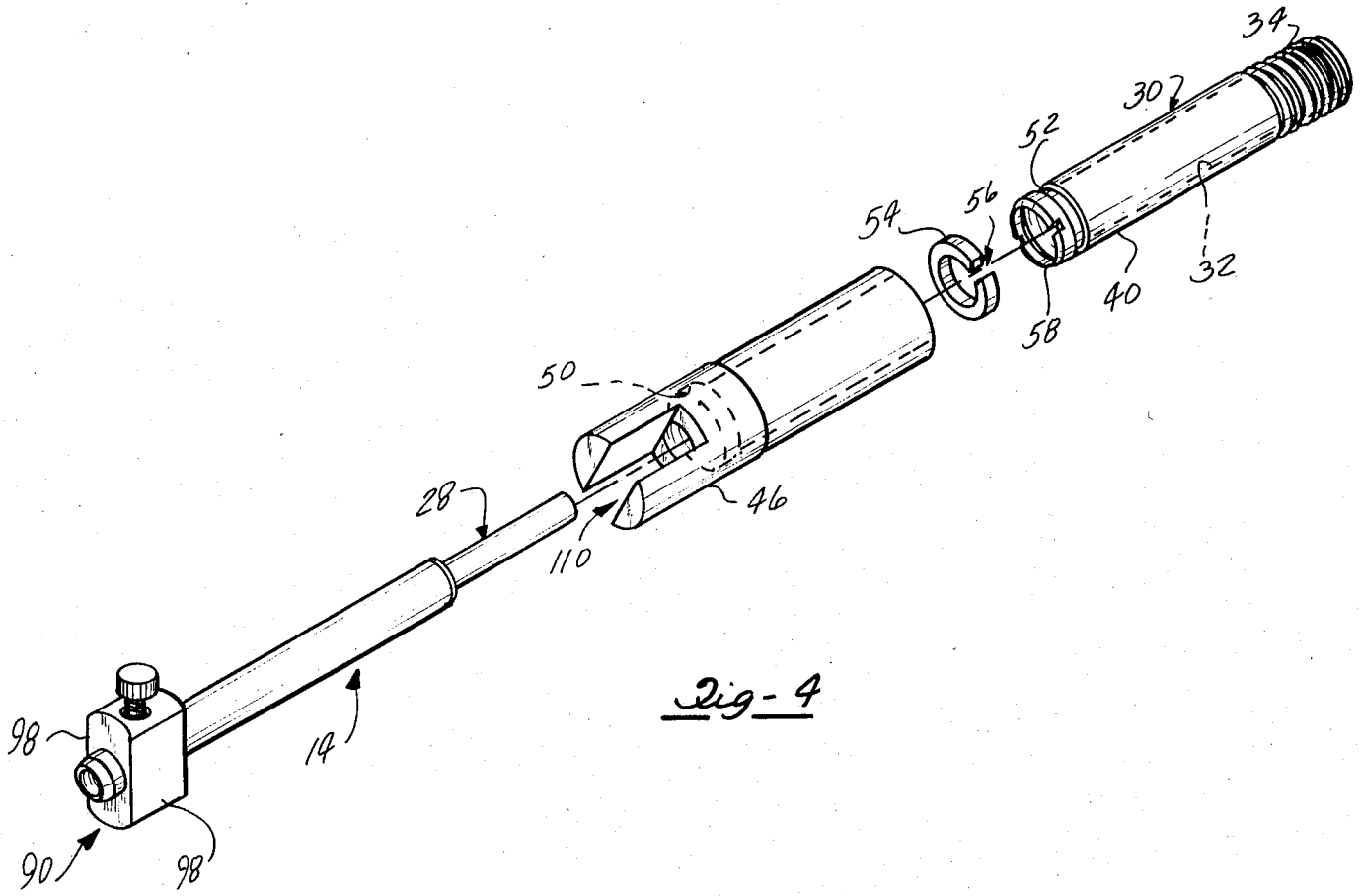
FIG. 4 illustrates an exploded view of the support bushing, tool holding assembly, and the tool support housing.

A tool support housing 38 is slidingly and rotatingly supported by the tool support bushing 30 by a support bushing outer portion 40, and is axially retained on the support bushing 30 by a retaining means 42 which will be described in greater detail subsequently. The tool support housing 38 includes an inner end 44 and an enlarged outer end 46. The retaining means 42 for axially securing the tool support housing 38 to the tool support bushing 30 and allowing rotation of the tool support housing relative to the tool support bushing comprises a longitudinal bore 48 formed in the tool support housing 38 for rotatingly engaging the support bushing outer portion 40, and a first groove 50 extending radially outward from the longitudinal bore 48. A second groove 52 is formed in the support bushing 30 and extends radially inward from the support bushing outer portion 40 and is axially aligned with the first groove 50. A retaining ring 54 is slidingly engageable with the first and second grooves 50, 52, and a gap 56 (as shown in FIG. 4 of the drawing) is formed in the circumference of the ring 54 to allow the ring to be squeezed radially inward for insertion into the longitudinal bore 48. The retaining ring 54 in a relaxed state is expandable into the first groove 50 partially radially filling the first groove. The retaining ring 54 is radially expandable past the relaxed state outward into the first groove 50 to allow the ring to slidingly pass over the bushing outer portion 40 and enter the second groove 52. Upon entering the second groove 52 the retaining ring 54 simulatneously engages the first and second grooves 50, 52 to prevent axial movement of the tool support housing 38 relative to the tool support bushing 30 while allowing free angular rotation of the tool support housing relative to the tool support bushing. A chamfer 58 formed on an outer end of the tool support bushing 30 aids in the engagement of the tool support bushing with the retaining ring 54 and the outward expansion of the retaining ring to fit over the bushing outer portion 40.

Referring now to FIG. 2 of the drawing, the tool holding assembly 14 comprises a tube 60 having a connecting rod end 62 and a threaded tool holder end 64 which includes a thread 66 formed internally along the tool holder end. The connecting rod end 62 of the tube 60 includes a first spherical socket 68 with an outwardly enlarging aperture 70 to provide clearance for the connecting rod 28 to swivel. The connecting rod 28 includes an enlarged spherical end 72 formed at the end of a rod 74. The rod 74 extends through the outward enlarging aperture and engages a crank pin opening 76 formed in the crank pin 24. A threaded bore 78 is formed in the crank pin 24 to receive a threaded fastener 80 which secures the rod 74 to the crank pin 24. A second spherical socket 82 is formed in the enlarged spherical end 72 to snugly receive a ball 84. A spring seat 86 includes a third spherical socket 88 to abut the ball 84. A tool support 90 includes a threaded end 92 to threadingly engage the threaded tool holder end 64. A biasing means comprising a spring 94 extends between the tool support 90 and the spring seat 86 to bias the spring seat 86 against the ball 84 and the ball 84 into abutment with the second spherical socket 82 and the enlarged spherical end into abutment with the first spherical socket 68. The biasing spring 94 limits the load that can be imposed upon the connecting rod 28 and prevents stalling of the drive motor and any resulting damage to the reciprocating mechanism when a load exceeding the biasing force is applied to the tool support 90. With the ball 84 positioned between and abutting the second and third sperical sockets the swiveling motion of the connecting rod is distributed one half between the ball and the second spherical socket and another half between the ball and the third sperical socket substantially reducing wear.

The tool support 90 as shown in FIG. 3 of the drawing includes a tool engaging end 96 having a pair of opposed flats 98 formed thereon. As shown in FIG. 2 of the drawing, a tool engaging bore 100 is provided to receive a shank of a tool (not shown). A threaded bore 102 intersects the tool engaging bore 100 and receives a threaded screw 104 to secure the tool in place.

As shown in FIG. 1 a shield 106 is provided to prevent the entry of chips and abrasives into the reciprocating mechanism. A means 108 is provided for attaching the shield 106 to the tool support 90. The means 108 comprises a screw 110 threadingly engaging a threaded bore 112 formed in the tool support 90, with the head of the screw 111 abuting the shield 106 to hold it in abutment with the tool support 90.

As shown in FIG. 4, a slot 110 is formed in the enlarged outer end 46 to snugly and slidingly abut the pair of opposed flats 98 providing transverse support for the tool support 90 and enabling the reciprocating mechanism to accommodate heavy transverse loads without experiencing excessive wear. The pair of opposed flats supported by the slot 110 together with the ball 84 resting in the second and third spherical seats and the enlarged spherical end 72 abutting the first spherical socket add substantially to the durability and wear resistance of the reciprocating mechanism of the present invention.

Prior art profilers are prone to have substantial wear and early failure because of a rather great distance between the bearing surfaces that support transverse tool loads and the tool. Also, the amount of bearing surface available to support the transverse load is limited in prior art devices. The present invention, by utilizing the retaining means 42, allows the use of a generous bearing surface for carrying transverse loads that is placed adjacent the tool. This reduces the over-hung load and increases the amount of bearing area to carry the load as well. This results in a substantial increase in the operating life of the reciprocating mechanism.

As shown in FIG. 3 of the drawing, a handle 120 is provided for rotating the tool support 90. The handle 120 comprises a body 122 secured to the tool support housing 38. The outer edges 124 are knurled for easy gripping of the handle 120 by the operator's hand. A pair of finger engaging projections 126 are provided to give the operator added leverage and convenience in rotating the tool holding assembly 14 with his fingers.

It can thus be seen that the present invention has provided a new and improved reciprocating mechanism for finishing dies etc. having an irregular surface. It can be readily seen by the skilled artisan that using the teachings of the present invention a reciprocating mechanism may be had that has superior wear resistance and utility and can be manufactured at a reasonable cost.

It should be understood by those skilled in the art of profilers or reciprocating mechanisms that other forms of the Applicant's invention may be had, all coming within the spirit of the invention and the scope of the appended claims.

Having thus described my invention what I claim is:

1. A hand-held reciprocating mechanism for driving a tool in linear reciprocation while accommodating rotation of the tool about its axis of linear reciprocation including:

a main housing;

an elongate, sleeve-like support bushing fixedly mounted at one end on said housing;

an elongate tool support assembly slidably received within said bushing for axial and rotary movement relative to said bushing and having a front end portion projecting outwardly from the other end of said bushing;

drive means in said housing coupled to said tool support assembly for driving said assembly in axial reciprocation within said bushing;

an outer sleeve member rotatively mounted upon the exterior of said bushing at an axially fixed location and having a front end section projecting outwardly beyond said other end of said bushing characterized in that:

the front end section of said outer sleeve member is of a diameter substantially greater than that of said bushing and is formed with a diametrical slot therethrough extending rearwardly from the front end of said front end section, and the front end portion of said tool support assembly is formed with a flattened, enlarged head section having a lateral extent substantially equal to that of the front end section of said outer sleeve member and slidably received and guided within said slot, said enlarged head section having an axial tool receiving passage therethrough and tool clamping means including a member passing radially through said head section at a location in said head section between the walls of said slot.

2. The reciprocating mechanism of claim 1 wherein the tool clamping means comprises:

a threaded bore formed in the head section intersecting said slot; and fastening means engaging said threaded bore to secure a tool in said slot.

3. The reciprocating mechanism of claim 1 further including:

shield means, mounted on the front end section of said outer sleeve, for enclosing and preventing the entry of chips and abrasives into the mechanism via the slot.

4. The reciprocating mechanism as defined in claim 1 wherein the retaining means for axially securing said tool support bushing and allowing rotation of said tool support housing relative to said tool support bushing comprises:

said support bushing having an externally threaded inner end and an outer end;

a longitudinal bore formed in said tool support assembly;

a first groove extending radially outward from said longitudinal bore;

said support bushing slidingly engageable with said longitudinal bore, a second groove extending radially inward formed in said support bushing and aligned with said first groove; and a retaining ring slidingly engageable with said first and second grooves, a gap formed in the circumference of said ring allowing said ring to be squeezed radially inward for insertion into said longitudinal bore, said retaining ring in a relaxed state expandable into said first groove partially radially filling said first groove, said retaining ring expandable radially outward into said first groove to slidingly pass over said support bushing and enter said second groove, and upon entering said second groove said retaining ring engages said first and second grooves preventing axial movement of said tool support housing relative to said tool support bushing and allowing free angular rotation of said tool support housing relative to said bushing.

5. The reciprocating mechanism as defined in claim 4 wherein the tool support assembly comprises:

a tube having a connecting rod end and a threaded tool holder end, said tube slidingly engageable with said central bore;

said connecting rod end comprising a first spherical socket with an outwardly enlarging aperture therethrough;

said connecting rod including an enlarged spherical end complementary to said first spherical socket with a rod extending through said outwardly enlarging aperture, said rod engaging a crank pin opening formed in said crank pin, a threaded bore formed in said crank pin intersecting said crank pin opening, a threaded fastener threadingly engaging said threaded bore to secure said rod to said crank pin, and a second spherical socket formed in the enlarged spherical end;

a ball snugly abutting said second spherical socket;

a spring seat including a third spherical socket snugly abutting said ball;

said tool support having a threaded end threadingly engaging said threaded tool holder end; and a biasing means extending between said tool support and said spring seat to bias said spring seat, said ball, said enlarged spherical end and said first spherical socket in abutment whereby stalling and damage to the reciprocating mechanism is avoided when a load exceeding said biasing force is applied to said tool support.

* * * * *